US007207239B2

(12) United States Patent
Mann et al.

(10) Patent No.: US 7,207,239 B2
(45) Date of Patent: Apr. 24, 2007

(54) COVER UNIT FOR AN ACTUATOR

(75) Inventors: Thomas Mann, Nidderau (DE); Rajko Colic, Bad Homburg (DE)

(73) Assignee: Siemens AG, München (DE)

( * ) Notice: Subject to any disclaimer, the term of this patent is extended or adjusted under 35 U.S.C. 154(b) by 358 days.

(21) Appl. No.: 10/463,343

(22) Filed: Jun. 18, 2003

(65) Prior Publication Data

US 2004/0025628 A1 Feb. 12, 2004

(30) Foreign Application Priority Data

Jun. 20, 2002 (DE) ..... 102 27 568

(51) Int. Cl.
*F16H 57/02* (2006.01)

(52) U.S. Cl. ..... 74/606 R

(58) Field of Classification Search ..... 74/606 R; 403/279, 282

See application file for complete search history.

(56) References Cited

U.S. PATENT DOCUMENTS

| | | | | |
|---|---|---|---|---|
| 5,608,611 | A | 3/1997 | Szudarek et al. | |
| 6,069,427 | A * | 5/2000 | Strahm et al. | 310/89 |
| 6,725,833 | B1 * | 4/2004 | Irihune et al. | 123/399 |

FOREIGN PATENT DOCUMENTS

| | | |
|---|---|---|
| DE | 28 35 919 C2 | 8/1978 |
| DE | 44 43 502 A1 | 6/1996 |
| DE | 195 16 584 A1 | 11/1996 |
| DE | 43 09 022 C3 | 3/1997 |
| DE | 197 09 243 C1 | 3/1997 |
| DE | 197 30 972 C1 | 10/1998 |
| EP | 1 104 228 A2 | 11/2000 |
| JP | 11343871 | 12/1999 |

OTHER PUBLICATIONS

Derwent-Abstract, DE 43 09 022 C2, 01/0571995, August Bilstein GmbH, D -58256 Ennepetal.
Derwent-Abstract, DE 28 35 919 C2, Jul. 9, 1987, Christian Boehm GmbH & Co. KG, D-8240 Berchtesgaden.
Derwent-Abstract, DE 195 16 584 A1, Nov. 7, 1996, Robert Bosch GmbH, D-70469 Stuttgart.
Derwent-Abstract, DE 44 43 502 A1, Jun. 13, 1996, Robert Bosch GmbH, D-70469 Stuttgart.
Derwent-Abstract, EP 1 104 228 A2, May 30, 2001, DaimlerChrysler AG, D-70567 Stuttgart.
Derwent-Abstract, DE 197 09 243 C1, Jun. 10, 1998, Siemens AG, D-80333 München.
Derwent-Abstract, DE 197 30 972 C1, Oct. 22, 1998, Siemens AG, D-80333 München.

* cited by examiner

*Primary Examiner*—Vicky A. Johnson
(74) *Attorney, Agent, or Firm*—Siemens AG; John Musone

(57) ABSTRACT

The present invention relates to a cover unit which includes a cover made of an aluminum alloy. The cover has a wall thickness of 1 to 2 mm and has at least one hollow pin on one side as well as an aperture. A plate-shaped plastic part provided with holes and a plug which projects through the aperture and is connected to the cover via at least one hollow pin. When attached, the plastic part holes engage the hollow pin(s) and the pin(s) are deformed so as to ensure a secure attachment. The invention also relates to a method of making the cover unit described above.

9 Claims, 3 Drawing Sheets

COVER UNIT FOR AN ACTUATOR

CONTINUATION DATA

The present invention claims priority to German patent application 10227568.8, filed Jun. 20, 2002, which is herein incorporated by reference.

BACKGROUND OF THE INVENTION

The present invention relates to a cover unit for an actuator, to a method of producing a cover unit for an actuator, and to the use of the cover unit.

Cover units for actuators are known. As a rule, they are directly connected to the housing of the actuator and protect gear members of the actuator from contaminants. Application of such cover units for actuators may be with a throttle valve in motor vehicles. Cover units for Throttle valve actuators are of multipiece design and consist of a cover and plate-shaped parts which are part of the electronic control of the actuator. In this case, the plate-shaped parts are connected via screwed connections to the respective cover, the wall thickness of which is between 2 and 3 mm and is made of a die casting. If there is a high power loss to the electrical components, the heat dissipation via the cast cover is often insufficient, resulting in adverse, damaging thermal effects. In particular, the electronic components which are arranged in the cover unit are adversely affected in the process.

SUMMARY OF THE INVENTION

An object of the present invention is to provide a cover unit for an actuator, in which cover unit thermal damage may be significantly avoided. Another object of the invention includes providing a method of producing the cover unit as well as the use of the cover unit.

These and other objects of the invention may be achieved by a cover unit for an actuator, which cover unit comprises an aluminum alloy with a wall thickness of 1 to 2 mm. The cover unit may further comprise at least one hollow pin on one side and an aperture. The cover unit may be a plate-shaped plastic part provided with holes and having a plug which projects through the aperture and which is connected to the cover via the hollow pins. The proportion of aluminum in the aluminum alloy is over 95% by weight. The range of the wall thickness, 1 to 2 mm, is not applicable to the at least one hollow pin, the wall thickness of which is less as a rule. The aperture in the cover may be an aperture in the form of a hole. The plate-shaped plastic part is of plate-shaped configuration in at least one plane. However, it is also possible to arrange the plate-shaped plastic part in a stepped plate-shaped manner or to design it in another way apart from a partial plate-shaped form. The plate-shaped plastic part may also comprise metal elements, which, for example, facilitate the electrical supply of the actuator. The plate-shaped plastic part may include a plug, which as a rule serves for the power supply of the actuator as well as for the exchange of information, for example, in the event of malfunctions. The plate-shaped plastic part is connected to the cover via the respective hollow pins in such a way that the latter, after the plate-shaped plastic part has been put onto the cover, are upset by plastic deformation and thus form a type of projection, so that the plate-shaped plastic part can no longer be released from the cover. The hollow pins are each of cylindrical design.

It has been found that thermal damage in the actuator may be avoided by the arrangement of the cover unit for an actuator with an effective connection between the cover and the plate-shaped plastic part being ensured at the same time. This is essentially brought about by the relatively small wall thickness of the cover, within a range of 1 to 2 mm, and by the type of aluminum alloy, so that heat occurring during operation can be dissipated from the cover unit relatively quickly. It is possible to select wall thickness of 1 to 2 mm since the connection between the cover and the plate-shaped plastic part need not be made via screwed connections, this necessitating a larger wall thickness.

An embodiment of the invention comprises a cover unit having three hollow pins formed therein. If three hollow pins are formed, there can also be greater actions of force, for example due to vibrations, on the plug without disadvantages to the cover unit of the actuator, since the connection between the cover and the plate-shaped plastic part is then sufficiently robust.

According to a further preferred embodiment of the invention, the at least one hollow pin has an inside diameter of 2 to 4 mm and a height of 3 to 6 mm. This facilitates plastic deformation and thus the arrangement of the plate-shaped plastic part in the cover.

A further embodiment of the invention includes the at least one hollow pin having a wall thickness of 0.4 to 0.6 mm. The wall thickness ensures reliable plastic deformation of the at least one hollow pin.

According to still a further embodiment of the present invention, a punched grid encapsulated with plastic is arranged as a plate-shaped plastic part. It is advantageously suitable for stabilizing and thus for improving the connection between the cover and the plate-shaped plastic part.

The above objects are further achieved by a method of producing a cover unit for an actuator, in which method, in a first step, a cover is formed from an aluminum alloy with a wall thickness of 1 to 2 mm by deep drawing or extrusion, at least one hollow pin being formed on one side and an aperture being arranged, and in which, in a second step, a plate-shaped plastic part which has holes for accommodating the at least one hollow pin of the cover and a plug is pushed onto the at least one hollow pin and is passed with the plug through the aperture and is then connected to the cover by plastic deformation of the at least one hollow pin. The expression "deep drawing" refers to the tensile/compressive formation of sheets to produce a hollow body. To this end, the cut-to-size sheet, which is made of an aluminum alloy, is put into a receptacle. A hold-down or press presses the sheet onto the drawing die and thus prevents fold formation during the deep drawing. The descending drawing punch presses the sheet into the drawing die and thus forms it into the desired cover. In comparison, extrusion is a cold-forming process for producing hollow or solid bodies. Either the compact solid material is forced through a die by a ram as in the case of direct extrusion, or the ram is forced into the solid material and the material flows backward along the ram. In order to obtain the plastic deformation of the at least one hollow pin, forces are caused to act on the respective outer end of the hollow pins, which have a cylindrical shape, so that a plate-shaped projection is formed, which prevents the plate-shaped plastic part from sliding back. In this case, it is advantageous that the connection between the cover and the plate-shaped plastic part be securely formed without the arrangement of a screwed connection, a factor which permits the selection of a small wall thickness of 1 to 2 mm of the cover. This connection remains secure even after prolonged operating periods and relatively large actions of force on the plug, it being ensured at the same time that the heat building up in the interior of the cover unit can be dissipated relatively quickly from the cover unit to the environment.

A further configuration of the invention includes the cover being formed from an aluminum alloy with a content of at least 99% by weight of aluminum. This facilitates the production of the cover by deep drawing or extrusion and at the same time permits very good heat dissipation of the heat built up in the interior of the cover unit.

The present invention includes its use, which for example may include use of the cover unit for an actuator for actuating a valve for cooling a water circuit of a motor vehicle. An adverse production of heat occurs in these actuators even after relatively short operating periods and can be countered effectively and quickly with the cover unit for an actuator.

BRIEF DESCRIPTION OF THE SEVERAL VIEWS OF THE DRAWINGS

The novel features believed characteristic of the invention are set out in the claims below. The invention itself, however, as well as other features and advantages thereof, are best understood by reference to the detailed description, which follows, when read in conjunction with the accompanying drawings, wherein:

DETAILED DESCRIPTION OF THE INVENTION

Figure 1:
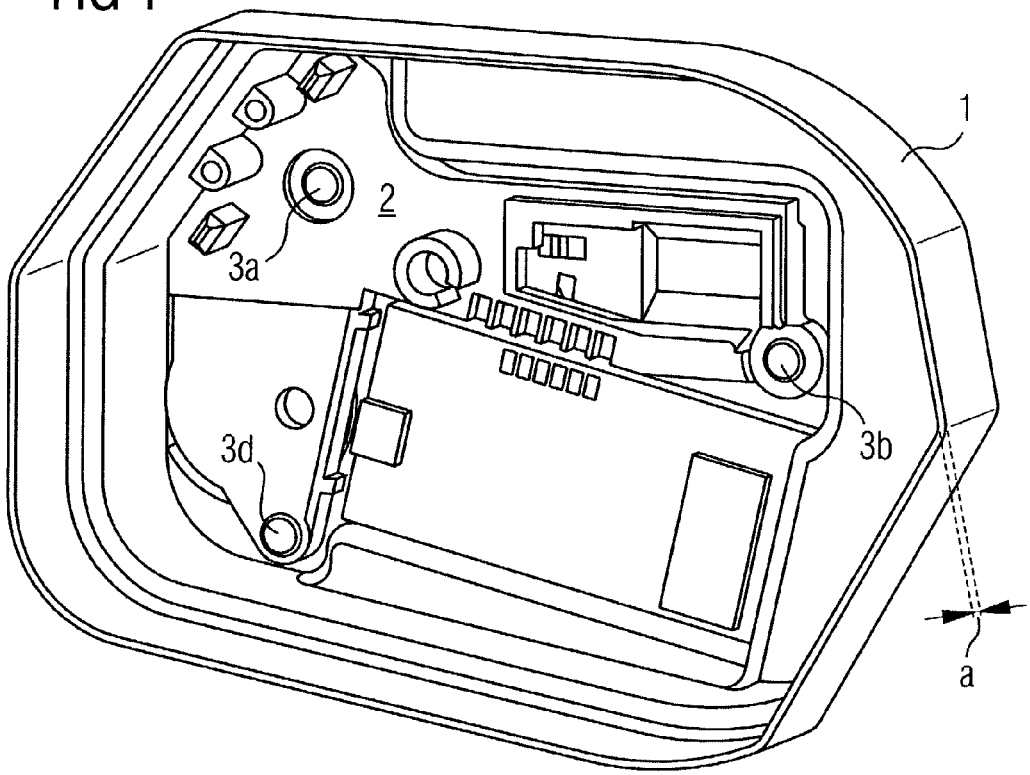
FIG. 1 depicts a rear view of an actuator cover unit.

A rear side of the cover unit for an actuator is shown in three-dimensional form in FIG. 1. The cover unit comprises a cover 1 which is made of an aluminum alloy and has a wall thickness a of 1 to 2 mm. On one side, the cover 1 is formed with three hollow pins 3*a*, 3*b*, 3*c* which serve to fasten a plate-shaped plastic part 2. To this end, the plate-shaped plastic part 2 is pushed onto the hollow pins 3*a*, 3*b*, 3*c*, and the hollow pins 3*a*, 3*b*, 3*c* are then altered by plastic deformation in such a way that in each case a plate-shaped projection which prevents the plate-shaped plastic part 2 from being pulled off is produced. The plate-shaped plastic part 2 is directly connected to the control electronics (not shown) and may also be configured as a punched grid encapsulated with plastic.

Figure 2:
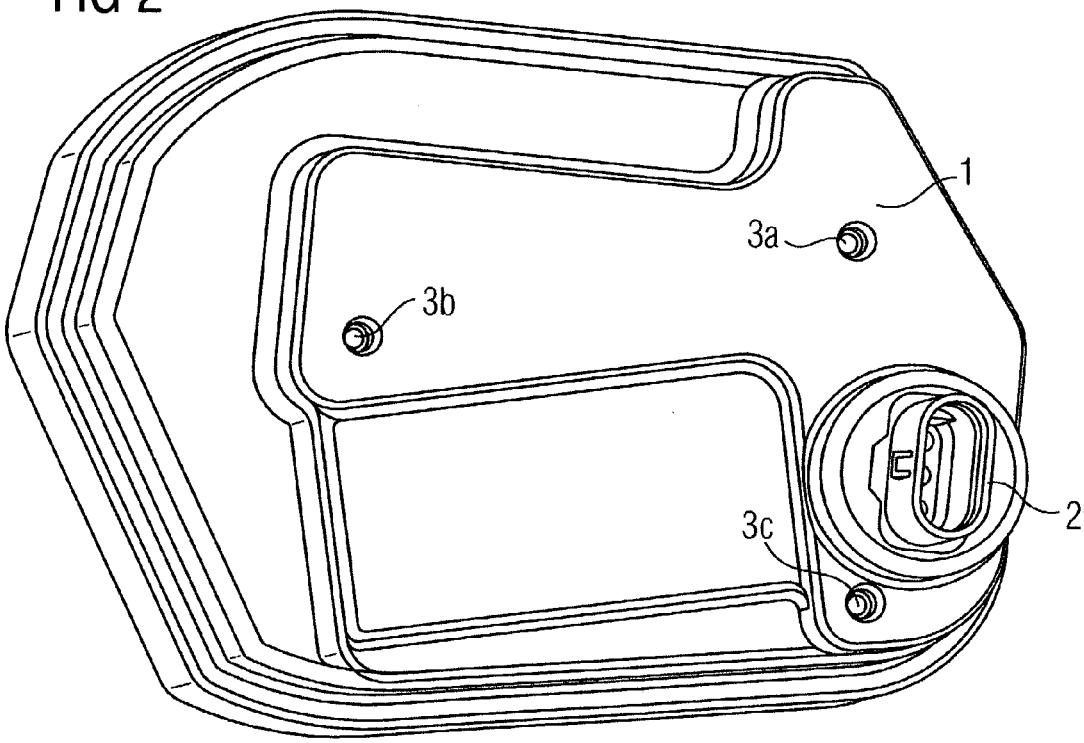
FIG. 2 depicts a front view of an actuator cover unit.

A front view of the cover unit for an actuator is depicted in FIG. 2. The plug 2' which serves for the electrical power supply and for the exchange of control information is passed through the cover 1.

Figure 3:
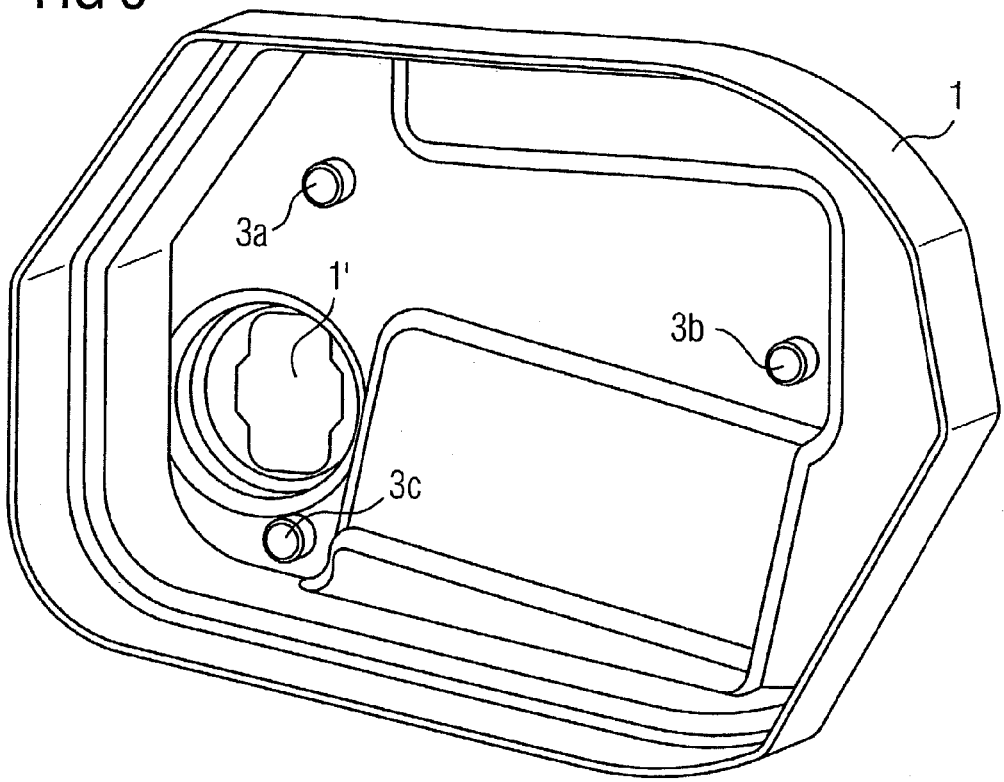
FIG. 3 depicts another rear view of an actuator cover unit.

A rear side of the cover 1 of the cover unit for an actuator is depicted three-dimensionally in FIG. 3. In addition to the hollow pins 3*a*, 3*b*, 3*c*, the cover 1 has an aperture 1' through which a plug (not shown) of the plate-shaped plastic part is passed.

Figure 4:
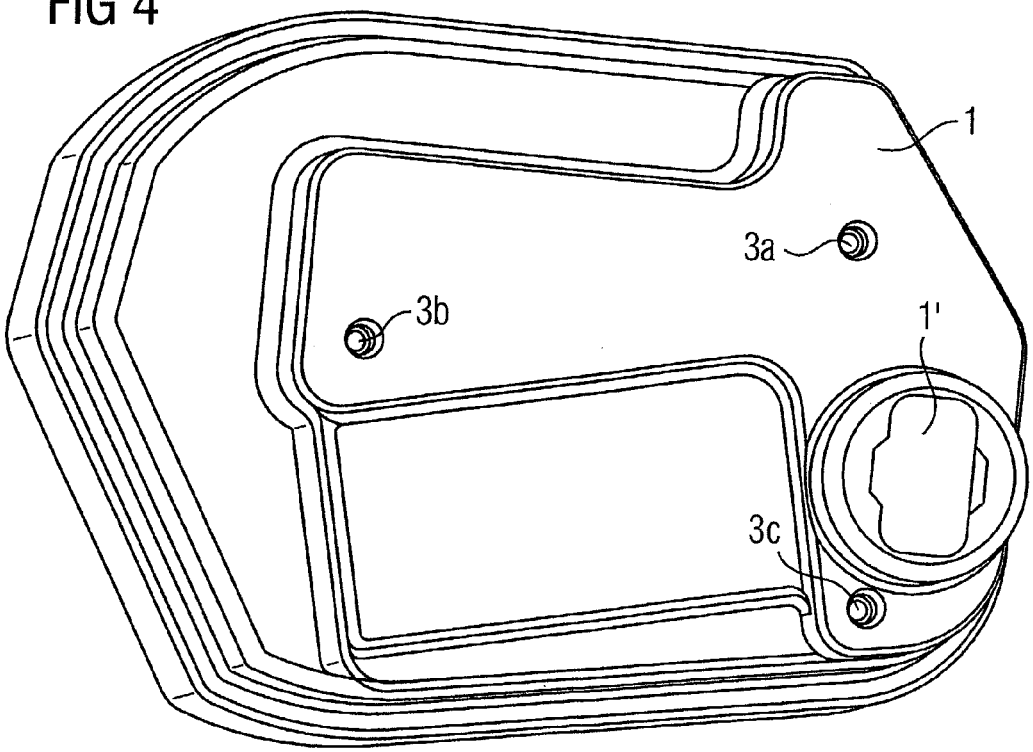
FIG. 4 depicts another front view of an actuator cover unit.

The front side of the cover 1 of the cover unit for an actuator is depicted in FIG. 4. The front side may be produced from an aluminum alloy which contains a proportion of aluminum of at least 99 percent by weight.

Figure 5:
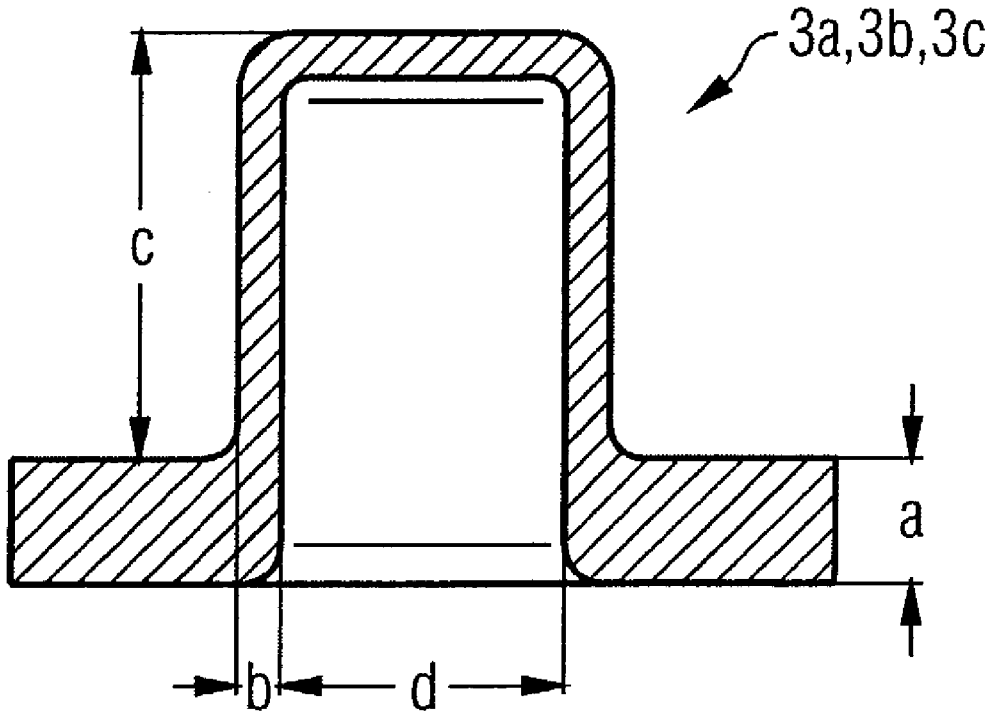
FIG. 5 depicts a cross section of a hollow pin.

Hollow pins 3*a*, 3*b*, 3*c* are shown in cross section in FIG. 5. In a preferred configuration, the inside diameter d lies within a range of 2 to 4 mm. In this case, it has a height c of 3 to 6 mm and a wall thickness b of 0.4 to 0.6 mm. As a rule, therefore, the wall thickness b of the hollow pin 3*a*, 3*b*, 3*c* is selected to be smaller than the wall thickness a of the cover (not shown), which is within a range of 1 to 2 mm.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A cover unit for an actuator, comprising:

a plate-shaped part comprising a plurality of holes and a plug, and an aluminum alloy cover having a thickness of 1 to 2 mm, an aperture, and at least one hollow pin, wherein said plate-shaped part attaches to said cover by cooperation of said at least one hollow pin and one of said plurality of holes such that said plug extends through said aperture, wherein said at least one hollow pin is deformed while within said hole so as to secure said plate-shaped part to said cover, and wherein said cover comprises at least 95% aluminum by weight.

2. The cover unit according to claim 1, wherein said at least one hollow pin comprises three hollow pins.

3. The cover unit according to claim 2, wherein at least one of said at least one hollow pin has an inside diameter of 2 to 4 mm.

4. The cover unit according to claim 2, wherein said plate-shaped part comprises a punched grid encapsulated with plastic.

5. The cover unit according to claim 1, wherein at least one of said at least one hollow pin has an inside diameter of 2 to 4 mm.

6. The cover unit according to claim 5, wherein said at least one of said at least one hollow pin has a height of 3 to 6 mm.

7. The cover unit according to claim 5, wherein said at least one hollow pin comprises a wall thickness of 0.4 to 0.6 mm.

8. The cover unit according to claim 1, wherein said plate-shaped part comprises a punched grid encapsulated with plastic.

9. The cover unit according to claim 5, wherein said plate-shaped part comprises a punched grid encapsulated with plastic.

* * * * *